US009617048B2

(12) United States Patent
Kroeyr et al.

(10) Patent No.: US 9,617,048 B2
(45) Date of Patent: Apr. 11, 2017

(54) PEELABLE AND RESEALABLE PACKAGING

(71) Applicant: The Hillshire Brands Company, Downers Grove, IL (US)

(72) Inventors: Jason A. Kroeyr, Geneva, IL (US); Jonathan C. Smyk, Chicago, IL (US)

(73) Assignee: The Hillshire Brands Company, Chicago, IL (US)

( * ) Notice: Subject to any disclaimer, the term of this patent is extended or adjusted under 35 U.S.C. 154(b) by 0 days.

(21) Appl. No.: 13/691,177

(22) Filed: Nov. 30, 2012

(65) Prior Publication Data

US 2013/0213967 A1 Aug. 22, 2013

Related U.S. Application Data

(60) Provisional application No. 61/566,323, filed on Dec. 2, 2011.

(51) Int. Cl.
*B65D 17/34* (2006.01)
*B65D 51/00* (2006.01)
*B65D 77/20* (2006.01)

(52) U.S. Cl.
CPC ..... *B65D 51/00* (2013.01); *B65D 77/2096* (2013.01); *B65D 2577/2066* (2013.01)

(58) Field of Classification Search
CPC ..... B65D 17/166; B65D 77/2056; B65D 77/2048; B65D 77/204; B65D 77/2036; B65D 77/2032; B65D 77/2028; B65D 77/2024; B65D 65/14; B65D 65/04; B65D 17/502
USPC ..... 220/259.1, 259.2, 270, 265, 266, 260, 220/359.4; 215/232; 53/492; 206/484.2, 206/484, 497, 813, 525; 229/123.1, 229/123.2, 125.35; 428/35.7, 35.8, 36.6, 428/36.7; 426/122, 123, 394, 396
See application file for complete search history.

(56) References Cited

U.S. PATENT DOCUMENTS

| | | | | |
|---|---|---|---|---|
| 4,098,404 | A | 7/1978 | Markert | |
| 4,420,080 | A | 12/1983 | Nakamura | |
| 4,437,293 | A | 3/1984 | Sanborn, Jr. | |
| 4,630,729 | A * | 12/1986 | Hirt et al. | 206/363 |
| 4,679,693 | A | 7/1987 | Forman | |
| 4,912,913 | A | 4/1990 | Rundle | |
| 5,011,006 | A * | 4/1991 | Anderson | 206/45.24 |
| 5,348,180 | A | 9/1994 | Shepard | |
| 5,431,619 | A | 7/1995 | Bacon et al. | |
| 5,873,483 | A * | 2/1999 | Gortz et al. | 220/269 |
| 6,076,969 | A | 6/2000 | Jaisle et al. | |

(Continued)

*Primary Examiner* — J. Gregory Pickett
*Assistant Examiner* — Allan Stevens
(74) *Attorney, Agent, or Firm* — Duane Morris LLP

(57) ABSTRACT

A resealable package includes a bottom portion defining an interior and including a sealing surface extending about a top of the interior; a film coupled to the bottom portion along at least a portion of the sealing surface and including a tab portion extending inward from one side of the top film; and a seal disposed between the film and the bottom portion and including at least first and second sides that intersect and form a seal portion tip. The seal seals the film to the bottom portion such that the film is configured to be resealably peeled away from the bottom portion along at least a portion of the seal area upon application of a force to the seal tip portion via the tab portion.

9 Claims, 3 Drawing Sheets

(56) References Cited

U.S. PATENT DOCUMENTS

| | | | | |
|---|---|---|---|---|
| 6,092,717 | A | 7/2000 | Lowry | |
| 6,120,426 | A | 9/2000 | Bacon | |
| 6,264,033 | B1 | 7/2001 | Kannabiran et al. | |
| 6,283,339 | B1 | 9/2001 | Morrow | |
| 6,315,448 | B1 | 11/2001 | Thrall | |
| 6,325,541 | B1 | 12/2001 | Thrall et al. | |
| 6,345,726 | B1 * | 2/2002 | Beeuwsaert | 220/359.3 |
| 6,360,909 | B1 | 3/2002 | Bridge | |
| 6,446,847 | B1 | 9/2002 | Huffer | |
| 6,450,355 | B1 | 9/2002 | Lowry | |
| 6,457,585 | B1 | 10/2002 | Huffer et al. | |
| 6,460,759 | B1 | 10/2002 | Lowry et al. | |
| 6,461,044 | B1 | 10/2002 | Anderson | |
| 6,471,058 | B2 | 10/2002 | Kannabiran et al. | |
| 6,478,465 | B1 | 11/2002 | Thrall | |
| 6,502,986 | B1 | 1/2003 | Bensur et al. | |
| 6,517,243 | B2 | 2/2003 | Huffer et al. | |
| 6,533,711 | B1 | 3/2003 | Anderson et al. | |
| 6,544,614 | B1 | 4/2003 | Huffer et al. | |
| 6,558,306 | B2 | 5/2003 | Lowry et al. | |
| 6,632,406 | B1 | 10/2003 | Michelin et al. | |
| 6,637,939 | B2 | 10/2003 | Huffer | |
| 6,662,827 | B1 | 12/2003 | Clougherty et al. | |
| 6,737,130 | B2 | 5/2004 | Ferri | |
| 6,742,703 | B2 | 6/2004 | Esakov et al. | |
| 6,776,301 | B2 | 8/2004 | Torres-White et al. | |
| 6,820,391 | B2 | 11/2004 | Barmore et al. | |
| 6,918,532 | B2 | 7/2005 | Sierra-Gomez et al. | |
| 6,921,203 | B2 | 7/2005 | Versluys | |
| 6,942,821 | B2 | 9/2005 | Dayrit et al. | |
| 6,953,148 | B2 | 10/2005 | Esakov et al. | |
| 7,185,780 | B2 | 3/2007 | Nomula | |
| 7,219,362 | B2 | 5/2007 | Beckwith et al. | |
| 7,244,496 | B2 | 7/2007 | Huffer | |
| 7,294,354 | B2 | 11/2007 | Gunter et al. | |
| 7,311,218 | B2 | 12/2007 | Varadarajan | |
| 7,318,524 | B2 | 1/2008 | Compton et al. | |
| 7,350,688 | B2 * | 4/2008 | Sierra-Gomez et al. | 229/87.08 |
| 7,422,782 | B2 | 9/2008 | Haedt et al. | |
| 7,494,605 | B2 | 2/2009 | Dayrit et al. | |
| 7,540,383 | B2 | 6/2009 | Huffer et al. | |
| 7,596,931 | B2 | 10/2009 | Gunter et al. | |
| 7,681,732 | B2 | 3/2010 | Moehlenbrock et al. | |
| 7,717,620 | B2 | 5/2010 | Hebert et al. | |
| 2002/0190114 | A1 | 12/2002 | Lowry et al. | |
| 2003/0091763 | A1 | 5/2003 | Ferri | |
| 2004/0126524 | A1 | 7/2004 | Longo et al. | |
| 2004/0159080 | A1 | 8/2004 | Stewart et al. | |
| 2004/0256348 | A1 | 12/2004 | Stevens et al. | |
| 2005/0000965 | A1 * | 1/2005 | Boardman | 220/359.1 |
| 2005/0127082 | A1 | 6/2005 | Nomula | |
| 2005/0167430 | A1 | 8/2005 | Varadarajan | |
| 2005/0194282 | A1 | 9/2005 | Kraimer et al. | |
| 2005/0252916 | A1 | 11/2005 | Varadarajan | |
| 2005/0254731 | A1 | 11/2005 | Berbert et al. | |
| 2005/0255196 | A1 | 11/2005 | Opuszko et al. | |
| 2005/0276525 | A1 | 12/2005 | Hebert et al. | |
| 2006/0043159 | A1 | 3/2006 | Roberts | |
| 2006/0096982 | A1 | 5/2006 | Gunter et al. | |
| 2006/0172131 | A1 | 8/2006 | Haedt et al. | |
| 2007/0007290 | A1 | 1/2007 | Setty et al. | |
| 2007/0014947 | A1 | 1/2007 | Mengel et al. | |
| 2007/0023435 | A1 | 2/2007 | Sierra-Gomez et al. | |
| 2007/0023436 | A1 | 2/2007 | Sierra-Gomez et al. | |
| 2007/0048421 | A1 | 3/2007 | Owensby et al. | |
| 2007/0082096 | A1 | 4/2007 | Dougherty et al. | |
| 2007/0082161 | A1 | 4/2007 | Cruz et al. | |
| 2007/0257044 | A1 | 11/2007 | Stevens | |
| 2007/0262077 | A1 | 11/2007 | Stevens | |
| 2008/0060321 | A1 | 3/2008 | Gunter et al. | |
| 2008/0248162 | A1 | 10/2008 | Cook et al. | |
| 2009/0226117 | A1 | 9/2009 | Davis et al. | |
| 2009/0232425 | A1 | 9/2009 | Tai et al. | |
| 2009/0289073 | A1 | 11/2009 | Moore et al. | |
| 2009/0301903 | A1 | 12/2009 | Andersson et al. | |
| 2009/0311454 | A1 | 12/2009 | Stephens | |
| 2010/0012533 | A1 | 1/2010 | Burgess | |
| 2010/0019022 | A1 | 1/2010 | Ryan et al. | |
| 2010/0113241 | A1 | 5/2010 | Hebert et al. | |

* cited by examiner

PEELABLE AND RESEALABLE PACKAGING

CROSS REFERENCE TO RELATED PATENT APPLICATIONS

The present application claims the benefit of U.S. Provisional Application No. 61/566,323, filed Dec. 2, 2011, which is incorporated herein by reference in its entirety.

BACKGROUND

The present disclosure relates generally to the field of packagings, and more specifically, to packagings used for food or other products that include easy-open peelable and resealable seal features.

SUMMARY

One embodiment relates to a resealable package comprising a bottom portion defining an interior and comprising a sealing surface extending about a top of the interior; a film sealed or otherwise coupled to the bottom portion along at least a portion of the sealing surface and comprising a tab portion extending inward from one side of the film; and a seal disposed between the film and the bottom portion and comprising at least first and second sides that intersect and form a seal portion tip; wherein the seal seals the film to the bottom portion such that the film is configured to be resealably peeled away from the bottom portion along at least a portion of the seal area upon application of a force to the seal portion tip via the tab portion.

Another embodiment relates to a package comprising a tray defining an interior having an open top; a flexible film; a seal sealing the tray to the flexible film in a peelable and resealable manner, the seal extending about the top of the interior and formed by a plurality of generally straight sides, the seal comprising a tip portion extending from an intersection of two of the plurality of generally straight sides; and a pull tab formed in the flexible film, the pull tab being defined by a plurality of laser scores in the flexible film.

Another embodiment relates to a package comprising an at least semi-rigid lower portion defining an interior; a flexible cover coupled to the lower portion via a peelable and resealable seal portion comprising five sides; wherein first and second sides of the seal portion extend parallel to one another and perpendicular to a third side, and wherein fourth and fifth sides of the seal portion extend from the first and second sides respectively and intersect adjacent a pull tab formed in the cover.

DETAILED DESCRIPTION OF EXEMPLARY EMBODIMENTS

Figure 1:
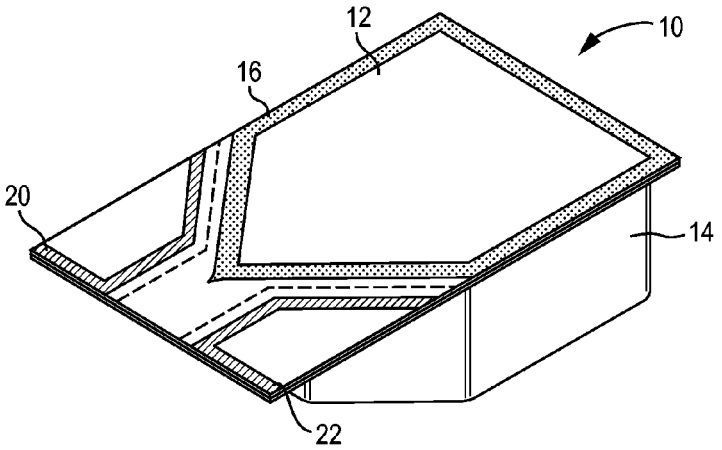
FIG. 1 is a perspective view of a package according to an exemplary embodiment.

Referring to FIGS. 1-4, a package 10 is shown according to an exemplary embodiment. Package 10 may be usable to store a variety of products, including various food products 15 such as meat products, deli meats, (e.g., pre-sliced lunch meat), etc., cheese products such as cheese slices, etc., cooked sausages I breakfast sausages, and numerous other food products. As discussed in detail herein, package 10 provides a peelable (e.g., openable, etc.) and resealable (e.g., closable, etc.) sealing feature that enables users to, for example, open package 10, access and remove a portion of a food product 15 contained in the interior of package 10, and reseal a remaining portion of the food product 15 within the packaging, making package 10 suitable for multiple serving/multiple use applications.

As shown in FIGS. 1-4, according to an exemplary embodiment, package 10 includes a top 12 (e.g., a lid, cover, flexible film, etc.), a bottom 14 (e.g., a tray, a rigid or semi-rigid formed tray or member, cup, receptacle, etc.), and a seal 16 (e.g., one or more seal portions, a multi-sided seal, adhesive or adhesive layer, etc.). One or more additional seals 20, 22 may also optionally be included. According to an exemplary embodiment shown in FIGS. 1-2, top 12 is coupled to bottom 14 by seal 16 and seals 20, 22.

Figure 2:
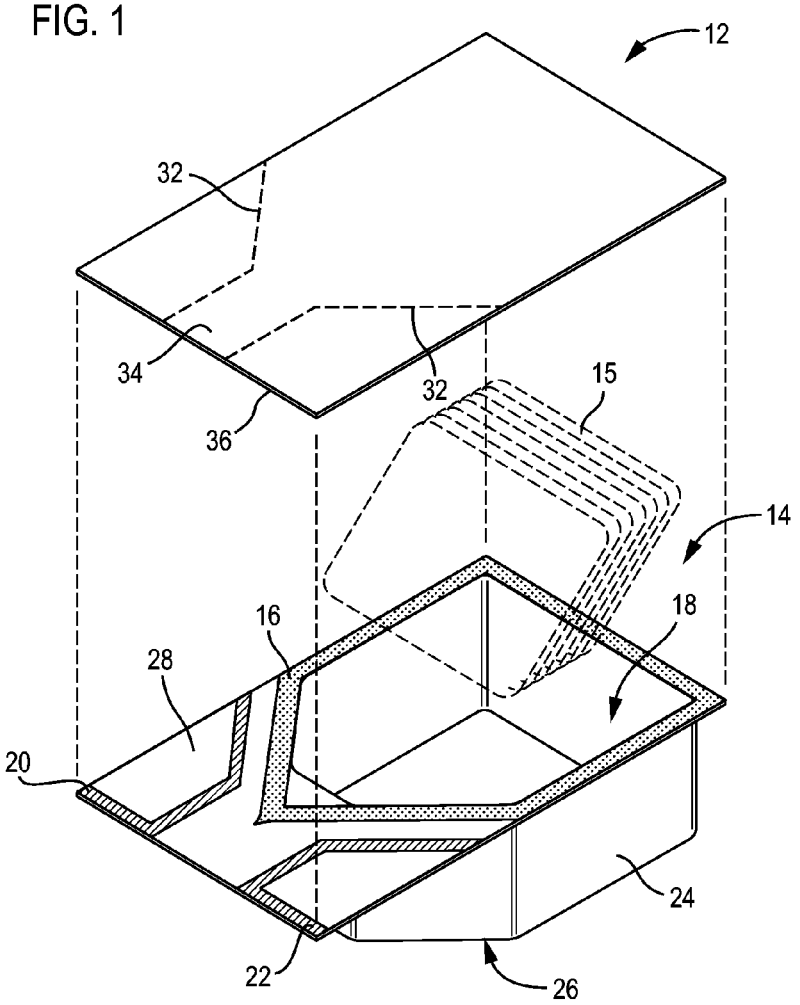
FIG. 2 is an exploded perspective view of the package of FIG. 1 and a food product according to an exemplary embodiment.
Figure 3:
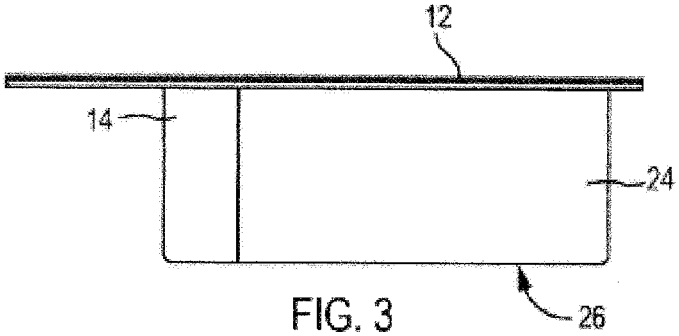
FIG. 3 is a side view of the package of FIG. 1 according to an exemplary embodiment.

According to an exemplary embodiment, bottom 14 includes a bottom wall 26 and one or more sidewalls 24 extending upward from bottom wall 26 to define an interior 18. An upper flange or lip portion 28 may extend around all or a portion of the top of interior 18. In one embodiment, as shown in FIGS. 1-2, bottom 14 may include six sidewalls 24. For example, second and third sidewalls 24 may extend in a perpendicular fashion from a first sidewall 24 and parallel to each other, and fourth and fifth sidewalls 24 may each extend at an angle from the second and third sidewalls to a sixth sidewall 24 that is generally parallel to the first sidewall (see, e.g., FIG. 2). In some embodiments, lip portion 28 is configured to provide a generally square or rectangular peripheral shape for the upper portion of bottom 14, such that even if interior 18 is multi-sided and/or irregularly shaped, the upper periphery of bottom 14 may still have a generally square, rectangular, other desired shape (e.g., oval, circular, etc.).

In some embodiments, lip portion 28 may a have a width between approximately 4 and 6 inches and a length of between approximately 7 and 10 inches. According to various alternative embodiments, lip portion 28 may have other lengths and/or widths. Sidewalls 24 have a height (measured from bottom wall 26 to lip portion 28) of approximately 2-4 inches, or some other suitable dimension.

It should be noted that bottom 14 may take a variety of shapes, sizes, and configurations according to various exemplary embodiments, and bottom 14 may be provided as a semi-rigid or rigid tray, a cup, a receptacle, or any similar component. In some embodiments, bottom 14 may be made from a semi-rigid thermoformable film that may be coextruded or formed by a lamination process. Bottom 14 may be produced using any suitable process such as a forming process (e.g., thermoforming, vacuum-forming, pre-forming, and the like). In one embodiment, bottom 14 is made of a polymer material and includes one or more of nylon, polypropylene, EVOH (an ethyl vinyl alcohol co-polymer), various sealants, and other materials.

According to an exemplary embodiment, top 12 is a flexible film that may be of a thinner gauge than bottom 14 to provide additional flexibility relative to bottom 14. Top 12 is configured to seal one or more products (e.g., food products 15) within interior 18. As shown in FIGS. 1-4, top 12 includes a tab 34 formed in the film material. Tab 34 is a pull tab configured to enable a user to grasp tab 34 and pull tab 34 back such that at least a portion of top 12 is peelably released from bottom 14 to expose the food product 15 contained within interior 18 and permit user access to interior 18. According to various embodiments, a sealant material may be incorporated into one or both of top 12 and bottom 14 (e.g., by providing a sealant that is laminated onto a film or coextruded as part of a film material).

Figure 4:
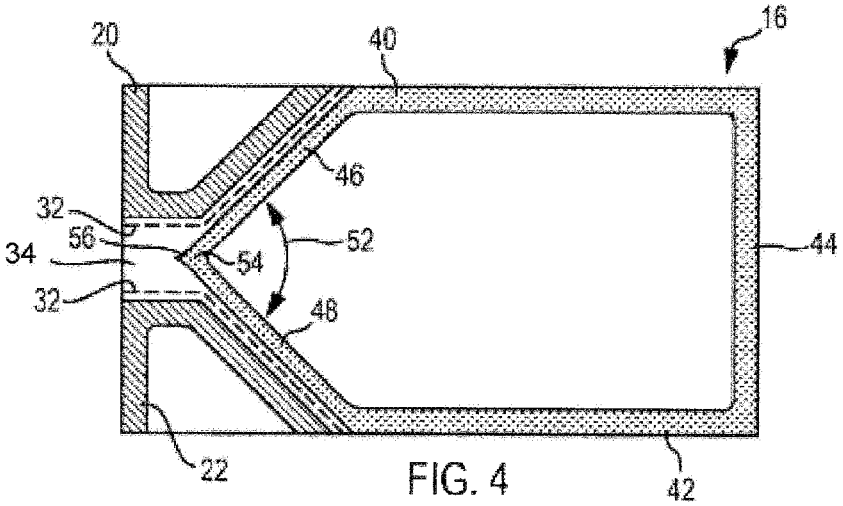
FIG. 4 is a top view of the packaging of FIG. 1 according to an exemplary embodiment.

According to an exemplary embodiment, tab 34 is defined in top 12 by a plurality of perforations 32 (e.g., laser scores or perforations, etc.). In one embodiment, perforations 32 extend from one side or edge 36 of top 12. According to further embodiments, laser scores or perforations extend from side 36 of top 12 such that tab 34 is positioned generally in the center portion of side 36. For example, in one embodiment as shown in FIG. 4, perforations 32 extend along two generally parallel lines from side 36 of top 12. The perforations then extend toward the lateral sides of top 12. According to various alternative embodiments, other configurations of perforations 32 may be utilized. Perforations 32 may be formed by a laser scoring operation, where a number of individual scores extend along a desire scoring path, and each individual score extends partially or wholly through the top film. Alternatively, a generally continuous laser score 32 may be provided that extends either partially or wholly through the top film.

Seal 16 maybe formed by providing a seal material (e.g., a pressure sensitive adhesive, a heat sensitive adhesive, a sealant such as an EVA and/or PE sealant layer, a combination thereof, etc.) between top 12 and bottom 14, and subsequently applying heat and/or pressure to seal 16 to form a peelable, resealable seal between top 12 and bottom 14. As shown in FIG. 2, seal 16 may extend around all or a portion of the top of interior 18, such that upon sealing top 12 to bottom 14, the food product 15 within interior 18 is generally sealed from the environment (e.g., the top and bottom provide a moisture and/or gas resistant barrier between interior 18 and the environment). It should be noted that while seals 16, 20, 22 are shown in FIG. 2 as being disposed on a lip 28 of bottom 14, seals 16, 20, 22 may alternatively be disposed on one or both of top 12 and lip 28. Further yet, the seals may be interposed as a separate material between the top and bottom such that seal 16 is formed upon application of heat and/or pressure to top 12 and bottom 14.

According to an exemplary embodiment, seal 16 includes a plurality of sides such as sides 40, 42, 44, 46, 48 shown in FIG. 4. According to an exemplary embodiment, the width of seal 16 is generally constant such that the width of each seal side 40-48 is substantially the same. Any suitable width may be used for seal 16 to provide the proper seal/reseal features discussed herein. Prior to sealing top 12 to bottom 14, seal 16 may be provided as a layer of suitable adhesive and/or other material on one or both of top 12 and bottom 14. The seal material may be applied to top 12 and/or bottom 14 using any suitable method.

According to one embodiment, seal 16 is a five-sided seal, such that first and second sides 40, 42 extend parallel to one another and in a perpendicular fashion from third side 44. Fourth and fifth sides 46, 48 extend from first and second sides 40, 42, respectively, and intersect to form an angle 52 (e.g., an interior angle formed by the inner portions of seal 16). According to one embodiment, angle 52 is approximately 90 degrees. According to further embodiments, angle 52 is no more than 90 degrees (e.g., such that angle 52 may be less than 90 degrees). According to yet further embodiments, angle 52 may be more than 90 degrees. According to alternative embodiments, sides 40-48 may have any of a variety of shapes and configurations (e.g., form a curved or circular portion of the seal, additional or fewer sides, etc.).

Figure 6:
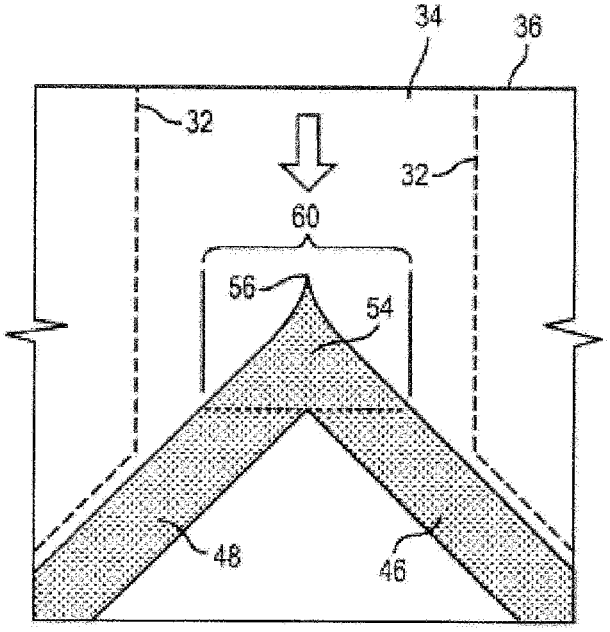
FIG. 6 is a detailed view of a portion of the package of FIG. 1 according to an exemplary embodiment

According to an exemplary embodiment, seal 16 includes a tip portion 54. In some embodiments, tip 54 is formed at least in part by the intersection of adjacent sides of seal 16 (e.g., forming the shape of a "chevron," or being generally V-shaped). For example, as shown in FIG. 6, tip 54 may be formed by fourth and fifth sides 46, 48 of seal 16. In some embodiments, tip portion 54 may include an extending portion 56. Portion 56 may be a seal portion having a width (e.g., a largest width dimension) substantially less than the width of the sides of seal 16 such that as a user pulls tab 34, seal 16 tends to release first at portion 56.

Figure 5:
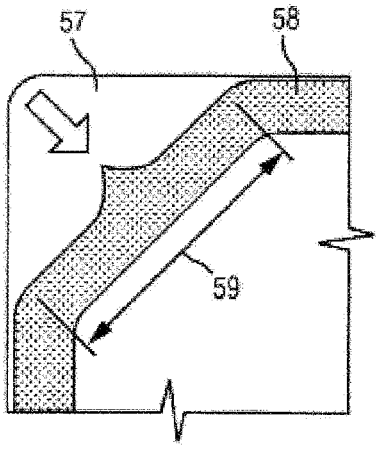
FIG. 5 is a detailed view of a portion of a package according to an alternative embodiment.

Referring to FIGS. 5 and 6, two different pull tab configurations are shown. In FIG. 5, a corner pull tab 57 is shown along with a seal 58. As a user pulls tab 57 in the direction shown, the user must over come the seal force provided by width 59 of seal 58. Referring to FIG. 6, tab 34 is shown extending inward from a central portion of side 36 of top 12, and seal 16 is shown to form a tip portion 54 having an extending portion 56. As a user pulls tab 34 in the direction shown, the user must over come the seal force provided by the width 60 of seal 16. Due to the geometry of the tab and seal, width 60 is less than width 59, thus enabling a user to overcome the seal forces of seal 16 shown in FIG. 6 using less force. The geometry of the chevron is configured to focus the force to permit easier opening while still providing a center line opening motion (instead of the less desirable corner opening). Furthermore, the interior angle of the chevron (e.g., angle 52) and the corresponding angle of the laser score pattern that defines tab 34 are configured to ensure that as tab 34 is pulled, top 12 tends to tear along the laser scores or perforations (e.g., toward the lateral sides of the packaging) rather than in a straight line down the center portion of the package.

In some embodiments, extending portion 56 may be defined by two outer edges of seal 16 extending toward each other and toward the edge of one side of top 12, thereby forming a generally triangular-shaped extending portion having a pointed or rounded tip closest to the edge of top 12. In other embodiments, other shapes, sizes, and configurations of tip 54 and extending portion 56 may be utilized.

Figure 7B:
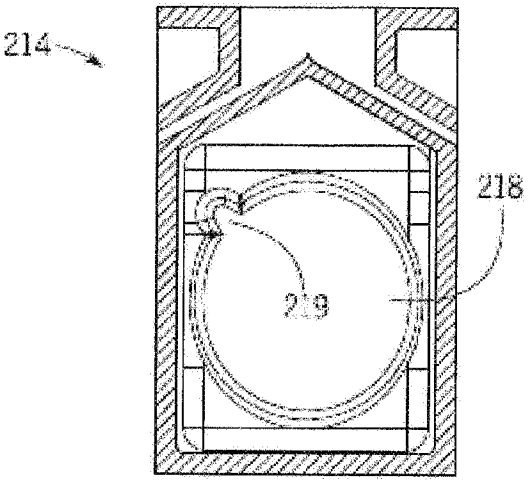
FIGS. 7A-7B illustrate alternative package configurations according to alternative embodiments.
Figure 7A:
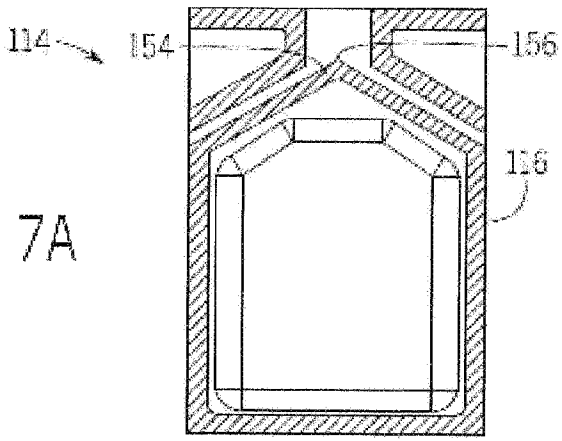

Referring to FIGS. 7A and 7B, alternative configurations for packages are shown according to alternative embodiments. Referring to FIG. 7A, a bottom 114 is shown with the locations of a seal 116 represented by cross-hatching. As can be seen in FIG. 7A, seal 116 includes a tip 154 having an extending portion 156. Tip 154 is formed at least in part by two intersecting sides of seal 116 forming an angle of greater than 90 degrees. FIG. 7B shows a bottom 214 similar to bottom 114, except bottom 114 includes a generally circular-shaped interior 218 and includes a finger hole 219 that may facilitate removing product from within interior 218. Other configurations for the bottom and seal of a package may be used according to various other alternative embodiments.

Figure 8C:
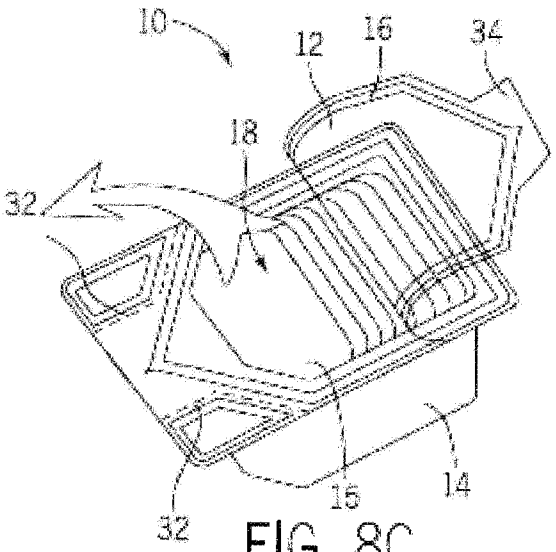
FIGS. 8A-8C illustrate a package containing a food product being peeled opened and resealed closed according to an exemplary embodiment.
Figure 8B:
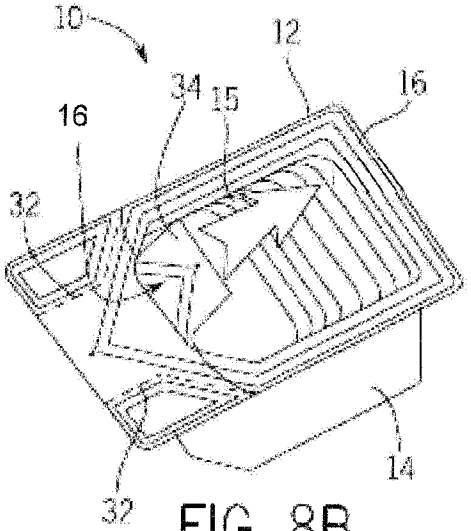
Figure 8A:
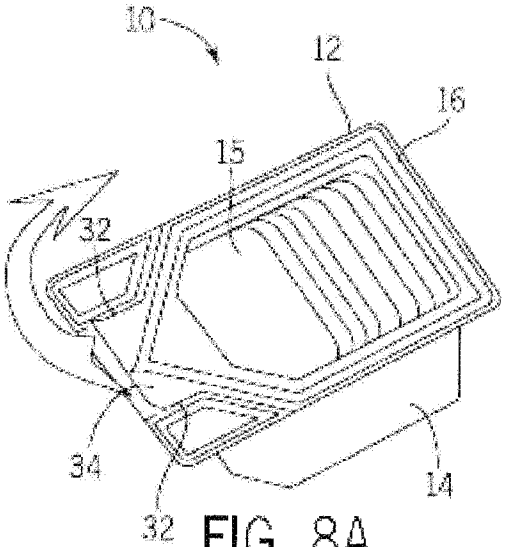

Referring now to FIGS. 8A-8C, in order to open package 10, a user grasps tab 34 and pulls tab 34 back along the central portion of package 10. Due to the centrally located position of tab 34, it may be intuitive to users to pull tab 34 generally along the center of package 10. As top 12 is peeled away from bottom 14, seal 16 is released, and perforations 32 are broken, or torn. As the seal releases, a frosty, or foggy appearance may remain on the top and/or bottom in locations of the seal(s). As such, the seal provides an anti-tampering feature, as the frosty/foggy appearance of the seal may provide evidence of tampering with the package. As the user continues to pull tab 34, interior 18 and the food product 15 therein become accessible. After removing a desired portion of food product 15, the user may then position top 12 back in its original position, and seal 16 will re-adhere top 12 to bottom 14 to again enclose the food product 15 within interior 18.

Perforations 32 are configured such that as a user pulls tab 34, top 12 is configured to rupture, or tear, along perforations 32. As such, the portions of top 12 sealed by seals 20, 22 remain sealed to bottom 14. Perforations 32 and seals 20, 22 may be configured such that as force is applied to top 12 via tab 34, perforations 32 tend to tear or rupture prior to seals 20, 22 releasing. As tab 34 is pulled further along, perforations 32 continue to tear and seal 16 releases, thereby exposing interior 18. As the user pulls tab 34, seal 16 tends to release in a "parallel" fashion on opposing sides of the package, such that when the user desires to reclose the package, seal 16 tends to return to its original position, thereby avoiding the sometimes difficult task of needing to realign the top and bottom package portions to reclose the package.

According to an exemplary embodiment, package 10 is produced by first forming bottom 14 (e.g., using a thermoforming process or other tool/die). In some embodiments a preformed bottom may be used. The food product 15 may be introduced into the interior of the bottom, top 12 may be placed over bottom 14, and a seal bar may apply heat and/or pressure to the seal portions illustrated herein. A seal/adhesive material (PSA) may be disposed on one or both of the top and bottom prior to application of pressure/heat by the seal bar. In some embodiments, a number of packages 10 may be formed simultaneously, and the individual packages cut/trimmed after top 12 is sealed to bottom 14. Furthermore, one or more labels may be provided on top 12 and/or bottom 14, and one or more portions of top 12 and/or bottom 14 may be transparent to permit viewing of a food product 15 within the interior of the package.

It should be noted that the package and method disclosed herein may provide various benefits over more typical packages. For example, the present package provides laser perforations/scoring and a peelable/resealable seal in an intuitive, easy-open package that provides high product visibility and premium appearance for consumers. Further, due to the central location of the tab and seal tip portion, the package is easier to open and reclose relative to other designs (e.g., corner tab configurations), where careful alignment of the top and bottom package components may be necessary to reclose the package. Other advantages may include increased surface area of the top, providing additional "billboard" space for advertising, transparent portions for viewing the food product, one or more holes for pegging/hanging the food product, additional access to the food product, etc.

Further yet, because the package may include a tab centrally located along a side of the package, the tab may be substantially larger than conventional corner tabs, and yet be released by using less peel force. As discussed above, the seal design and geometry may further facilitate the "resealability" of the packaging by making it easier to lay the top film back down onto the bottom tray properly.

It is important to note that the construction and arrangement of the elements of the package and methods as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the embodiments. Accordingly, all such modifications are intended to be included within the scope of the present disclosure as defined in the appended claims. The order or sequence of any process or method steps may be varied or re-sequenced according to alternative embodiments. Other substitutions, modifications, changes, and/or omissions may be made in the design, operating conditions, and arrangement of the exemplary embodiments without departing from the spirit of the present disclosure.

What is claimed is:

1. A resealable food package comprising:

a tray having a bottom connected to each of a plurality of sides terminating at an opening, the plurality of sides having a substantially same height which defines an interior for receiving a food product, the plurality of sides comprising:

two opposing substantially parallel sides of substantially a same first length;

a third side connected to and substantially perpendicular to each of the two opposing parallel sides;

a fourth side shorter than and substantially parallel to the third side; and two angled sides of substantially a same second length wherein one of the angled sides is connected to one of the opposing parallel sides and the fourth side and the other angled side is connected to the other opposing parallel side and the fourth side, wherein each of the plurality of sides includes an upper lip portion wherein said upper lip portion of the two angled sides and the fourth side is substantially extended in a direction away from the third side;

a first seal applied to a topside of the upper lip portions and circumscribing an irregular pentagon about the opening, wherein a portion of the irregular pentagon forms a chevron pointing away from the third side;

a second and third seal applied to a topside of the extended upper lip portion such that each of the first, second, and third seal is separated from one another; and a film releasably attached to the upper lip portions by the first seal and further attached to the upper lip portions by the second and third seals, wherein said film includes a tab portion formed by a first perforation having a first portion disposed between the second and third seals and a second portion disposed between the second seal and a first side of the first seal that forms the chevron, and a second perforation having a first portion disposed between the third and second seals and a second portion disposed between the third seal and a second side of the first seal that forms the chevron, wherein the first portions of the first and second perforations are substantially parallel and spaced apart and terminate at an edge of the film positioned furthest from the third side, wherein the tray, the first seal, and the film form a gas resistant barrier between the interior and an external environment and wherein said gas resistant barrier is undisturbed by the first and second perforations, and wherein said tab portion is configured to allow a user to peel away the film from the tray along the first and second perforations towards the third side thereby releasing the film from the first seal to expose the interior to the external environment, and wherein said package is configured to allow the user to reapply the film to the tray by contacting the film to the first seal.

2. The package of claim 1, wherein the interior contains a food product.

3. The package of claim 1, wherein the first seal has a substantially constant width.

4. The package of claim 1, wherein the first seal comprises an adhesive configured to be substantially retained on the film when the film is peeled away from the upper lip portion.

5. The package of claim 1, wherein the first and second perforations comprise laser scores.

6. The package of claim 5, wherein the laser scores extend partially through the film.

7. The package of claim 1, wherein the tray is a semi-rigid thermoformed member or a preformed member and the film is a flexible polymer film.

8. The package of claim 1, wherein the first seal comprises a sealant configured to enable a user to peel the film away from the tray and subsequently reseal the film to the tray.

9. The package of claim 1, wherein said film is substantially rectangular having a long side substantially perpendicular to the third side, and wherein a direction of peel of the film from the tray is parallel to the long side of the film.

* * * * *